US005699715A

United States Patent [19]

Forster

[11] Patent Number: 5,699,715

[45] Date of Patent: Dec. 23, 1997

[54] PISTON FOR A RECIPROCATING PISTON MACHINE

[75] Inventor: Franz Forster, Karlstadt-Mühlbach, Germany

[73] Assignee: Linde Aktiengesellschaft, Germany

[21] Appl. No.: 681,271

[22] Filed: Jul. 22, 1996

[30] Foreign Application Priority Data

Jul. 28, 1995 [DE] Germany ..... 195 27 648.5

[51] Int. Cl.[6] ..... F01B 3/00

[52] U.S. Cl. ..... 92/12.2; 92/71; 74/60

[58] Field of Search ..... 92/12.2, 138, 71; 417/269, 222.1, 222.2; 74/60

[56] References Cited

U.S. PATENT DOCUMENTS 1,517,386 12/1924 Almen ..... 92/138

5,370,503 12/1994 Terauchi ..... 417/222.2

5,490,767 2/1996 Kanou et al. ..... 417/222.2

FOREIGN PATENT DOCUMENTS 415432 6/1925 Germany .

*Primary Examiner*—Thomas E. Denion

*Attorney, Agent, or Firm*—Webb Ziesenheim Bruening Logsdon Orkin & Hanson, P.C.

[57] ABSTRACT

A piston for use in a reciprocating piston machine having a wobble plate has a first segment and a second segment axially spaced from and aligned with the first segment. A bridge segment connects the first and second piston segments for simultaneous reciprocal movement and at least one body is attached to the bridge segment to connect the piston to a wobble plate.

20 Claims, 1 Drawing Sheet

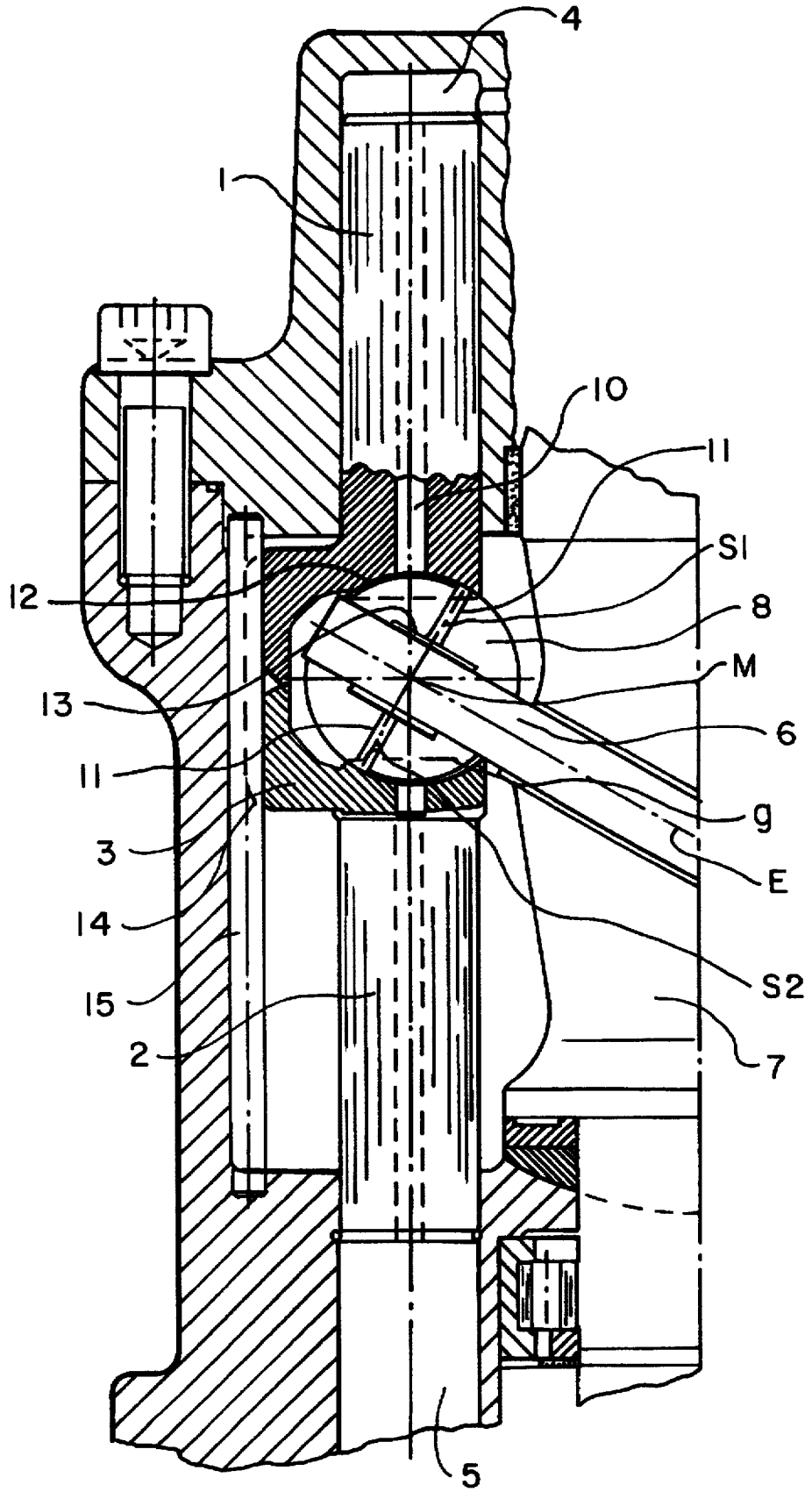
4
1
10
11
S1
12
8
M
13
6
11
9
3
E
14
S2
15
2
7
5

PISTON FOR A RECIPROCATING PISTON MACHINE

BACKGROUND OF THE INVENTION

1. Field of the Invention

The invention relates generally to a piston for use in a reciprocating piston machine and more particularly to a piston having a first piston segment and a second piston segment axially spaced from the first piston segment and a bridge segment connecting the first and second piston segments.

The piston is operatively adapted to be connected to a wobble plate by the bridge segment, and during operation of the machine, there is a relative velocity between the piston and the wobble plate which is perpendicular to the center axis of the piston and tangential to the wobble plate. Two semi-spherical body members are mounted in the bridge segment for connecting the bridge segment to a wobble plate.

2. Description of Related Prior Art

Pistons are used in axial piston machines having a wobble plate. When the drive is applied to the wobble plate, the length of the stroke of the piston will vary in accordance with the magnitude of the angle of the wobble plate relative to the axis of the machine. Conversely, when the piston is driven, different angles of rotation of the wobble plate can be used.

The prior art describes a similar piston in a swash plate type hydrostatic axial piston machine in DE-PS 415 432. In that axial piston machine, the maximum angle of inclination of the wobble plate is on the order of 18° to 20° and appears to be approximately 20°.

SUMMARY OF THE INVENTION

An object of the invention is to provide a piston which has an improved connection with a wobble plate. This is accomplished by utilizing a pair of support bodies in the form of coaxial spherical segments which have mean perpendiculars.

As a result of the construction of the invention, the angle of inclination of the wobble plate can be significantly increased, as a result of which either the piston stroke or the angle of rotation of the wobble plate is increased proportionally, depending upon the direction of the drive.

The power of an axial piston machine is defined as the product of the geometric volume flow (which is the product of the displacement volume per revolution and the speed of revolution of the axial piston machine) and the operating pressure. If the piston is used in a hydraulic displacement machine, such as a hydrostatic axial piston machine having a wobble plate or a swash plate type construction, the geometric volume flow can be significantly increased. The power of a machine equipped with the piston of the invention can be increased proportionally.

Moreover, the piston of the invention is shorter than the piston disclosed in the above-referenced prior art document. The compact dimensions of the piston result in more compact overall dimensions of the machine equipped with such pistons.

If the midpoint of the sphere formed by the spherical segments is located on the center axis of the two piston segments, the piston force is favorably split. The same is true in the arrangement wherein the center of the sphere formed by the spherical segments is located on the centerline of the wobble plate which is located between the spherical segments. The formation of support bodies as spherical segments permits a decrease in the size of the parts inventory which must be maintained.

An advantage of the invention is that the two piston segments have the same diameter so that when the two piston segments are located in a common plane and are connected to a wobble plate on the same radius, the forces in the axial direction are equalized with an alternating force applied to the opposed ends of the piston segments.

The piston of the invention can be used in a system wherein the piston is displaced by a pressure medium or pressurizes a pressure medium on opposite ends of the piston, i.e., as a power source or as a pump. It is also possible to use one piston segment to guide the other piston segment which pressurizes a pressure medium or is displaced by a pressure medium.

In order to achieve a linear smoothly operating connection between the piston and a wobble plate, each spherical segment support body has a hydrostatic bearing on the surface facing the bridge segment and on the surface facing a wobble plate. This type of bearing is readily provided when the piston is used in a hydrostatic machine.

The arrangement of the invention also prevents undesirable rotation of the piston segments around their center axes. In this regard, the bridge segment is formed with an elongated axial groove on the outer surface which is adapted to contact an elongated guide profile on the housing.

A complete understanding of the invention will be obtained from the following description when taken in connection with the accompanying drawing figure wherein like reference characters identify like parts throughout.

BRIEF DESCRIPTION OF THE DRAWING

The drawing Figure is a schematic partial longitudinal section through a piston according to the invention installed in the housing of a hydrostatic axial piston machine.

DESCRIPTION OF THE PREFERRED EMBODIMENT

With reference to the drawing figure, the piston has a first piston segment 1 and a second piston segment 2 which is axially spaced from the first piston segment. The piston segments 1 and 2 are coaxial and have the same diameter. A bridge segment 3 connects the spaced ends of the piston segments 1 and 2 so that the piston segments simultaneously move lengthwise in the spaced aligned cylindrical bores 4 and 5 formed in the machine housing. Depending upon the desired use of the machine, the ends of the piston can be pressurized by a pressure medium (e.g., for operation as a hydraulic motor) or can be used to displace a pressure medium (e.g., for operation as a hydraulic pump).

The bridge segment 3 is adapted to be connected to a wobble plate 6 which is connected to a machine shaft 7, so that in operation, there is a relative velocity perpendicular to the center axis of the piston and tangential to the wobble plate.

Two support bodies 8 and 9 in the form of spherical segments having mean perpendiculars S1 and S2 are located within the bridge segment 3. The wobble plate 6 is located between the flat surfaces of the support bodies 8 and 9 which form a surrounding sphere. The center M of the sphere preferably lies on the center plane E of the wobble plate 6 which is located between the support bodies 8 and 9.

As a result of the configuration of the piston of the invention, a much larger angle of inclination of a wobble plate 6 is possible than in similar systems of the prior art. This makes it possible to obtain a significant increase in the power of the axial piston machine equipped with pistons according to the invention.

Each support body 8 and 9 is formed with a hydrostatic bearing in the surface facing the bridge segment 3 and in the surface facing a wobble plate 6. The bearings are supplied with fluid by the axial passageways 10 located in the piston segments 1 and 2 and by the radial passageways 11 located in the support bodies 8 and 9. The hydrostatic bearings are created by the pressure pockets 12 which are formed in the bridge segment 3 and the pressure pockets 13 which are formed in the support bodies 8 and 9. As a result of the hydrostatic bearings in the support bodies 8 and 9, a smooth sliding movement of a rotating wobble plate 6 between the support bodies 8 and 9 can be obtained. Additionally, the support bodies pivot evenly and smoothly within the bridge segment 3.

An elongated axial groove 14 is formed in the outside of the bridge segment 3 to receive an elongated guide rod 15 which is connected to the machine housing to prevent rotation of the piston segments 1 and 2 around their center axes. Alternatively, the bridge segment 3 may be formed with an elongated spine which will cooperate with a guide groove formed in the housing.

It will be understood by those skilled in the art that the piston of the invention can be used in an axial piston machine utilizing the swash plate principle, if the cylindrical drum and the swash plate are appropriately adapted, as well as in other reciprocating axial piston machines.

While the invention is described in detail herein, it will be appreciated by those skilled in the art that various modifications and alternatives to the arrangement can be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A piston for use in a reciprocating piston machine having a wobble plate, said piston having a first piston segment and a second piston segment axially spaced from and aligned with said first piston segment, a bridge segment connecting said first and second piston segments for simultaneous reciprocal movement, and a means for operatively connecting said piston to a wobble plate, whereby a relative velocity perpendicular to the center axis of said piston and tangential to a wobble plate occurs between said piston and said wobble plate during reciprocal movement of said piston, wherein said means for operatively connecting said piston to said wobble plate includes a cavity in said bridge segment and two support bodies mounted within said cavity in said bridge segment which are adapted to lie on opposed sides of said wobble plate wherein each of said two support bodies mounted in said bridge segment is a segment of a sphere and said segments have coaxial mean perpendiculars wherein said piston has opposed ends for one of the displacement of a pressure medium and the pressurization of a pressure medium.

2. A piston as set forth in claim 1, wherein said first piston segment and said second piston segment are coaxial.

3. A piston as set forth in claim 1, wherein said spherical segments form a sphere having a center located on the center axis of said first and second piston segments.

4. A piston as set forth in claim 1, wherein said spherical segments form a sphere having a center adapted to be located on the center plane of a wobble plate located between said support bodies.

5. A piston as set forth in claim 3, wherein said spherical segments form a sphere having a center adapted to be located on the center plane of a wobble plate located between said support bodies.

6. A piston as set forth in claim 2, wherein said spherical segments form a sphere having a center adapted to be located on the center plane of a wobble plate located between said support bodies.

7. A piston as set forth in claim 1, wherein said support bodies are segments of a common surrounding sphere.

8. A piston as set forth in claim 2, wherein said support bodies are segments of a common surrounding sphere.

9. A piston as set forth in claim 8, wherein said spherical segments are segments of a common surrounding sphere.

10. A piston as set forth in claim 1, wherein said first piston segment and said second piston segment have the same diameter.

11. A piston as set forth in claim 1, including hydrostatic bearings on a surface of each of said support bodies within said bridge segment and on the surface of each of said support bodies adapted to face said wobble plate.

12. A piston as set forth in claim 1, including means on said bridge segment for preventing rotation of said piston around the center axis of said piston.

13. A piston as set forth in claim 1, wherein said bridge segment has an outwardly opening elongated axial groove formed thereon adapted to contact a guide profile on a housing for said piston to prevent rotation of said piston around the axis of said piston.

14. A piston for use in a reciprocating piston machine having a wobble plate, said piston having a first piston segment and a second piston segment axially spaced from and aligned with said first piston segment, a bridge segment connecting said first and second piston segments for simultaneously reciprocal movement, and means for operatively connecting said piston to said wobble plate, said means including a cavity in said bridge segment and two support bodies mounted within said cavity in said bridge segment and adapted to lie on opposite sides of said wobble plate, pressure pockets formed in said bridge segment adjacent each said support body creating hydrostatic bearings on a surface of each said support body within said bridge segment, and a pressure pocket formed on a surface of each said support body facing said wobble plate whereby a hydrostatic bearing is formed between said support bodies and said wobble plate, whereby a relative velocity perpendicular to the center axis of said piston and tangential to a wobble plate occurs between said piston and said wobble plate during reciprocal movement of said piston.

15. A piston as set forth in claim 14, wherein said support bodies are segments of a common surrounding sphere.

16. A piston as set forth in claim 14, wherein said piston has opposed ends for one of the displacement of a pressure medium and the pressurization of pressure medium.

17. A piston as set forth in claim 14, wherein said bridge segment has an outwardly opening elongated axial groove formed thereon adapted to contact a guide profile on a housing for said piston to prevent rotation of said piston around the axis of said piston.

18. A piston as set forth in claim 14 wherein each said piston segment includes an axial passageway extending to one said pressure pocket formed in said bridge segment.

19. A piston as set forth in claim 18, wherein said bridge segment has an outwardly opening elongated axial groove formed thereon adapted to contact a guide profile on a housing for said piston to prevent rotation of said piston around the axis of said piston.

20. A piston as set forth in claim 19 further including radial passageways extending through each said support body to said pressure pocket formed in said support body.

* * * * *

UNITED STATES PATENT AND TRADEMARK OFFICE

CERTIFICATE OF CORRECTION

PATENT NO. : 5,699,715

DATED : December 23, 1997

INVENTOR(S) : Franz Forster

It is certified that error appears in the above-identified patent and that said Letters Patent is hereby corrected as shown below:

Claim 1 Column 3 Line 46 after "wobble plate" insert comma --,--.

Claim 1 Column 3 Line 48 after "perpendiculars" insert comma --,--.

Signed and Sealed this

Twenty-first Day of April, 1998

Bruce Lehman

*Attest:*

BRUCE LEHMAN

*Attesting Officer*

*Commissioner of Patents and Trademarks*